US011982074B2

(12) United States Patent
Wilks

(10) Patent No.: US 11,982,074 B2
(45) Date of Patent: May 14, 2024

(54) FAUCET ASSEMBLY WITH A WASHABLE HANDLE

(71) Applicant: Freeman Wilks, Sunrise, FL (US)

(72) Inventor: Freeman Wilks, Sunrise, FL (US)

( * ) Notice: Subject to any disclaimer, the term of this patent is extended or adjusted under 35 U.S.C. 154(b) by 255 days.

(21) Appl. No.: 17/548,437

(22) Filed: Dec. 10, 2021

(65) Prior Publication Data

US 2022/0186477 A1 Jun. 16, 2022

Related U.S. Application Data

(60) Provisional application No. 63/205,442, filed on Dec. 10, 2020.

(51) Int. Cl.
*E03C 1/04* (2006.01)

(52) U.S. Cl.
CPC ..... *E03C 1/0412* (2013.01)

(58) Field of Classification Search
CPC ..... E03C 1/0412; E03C 1/0404; E03C 1/04; F16K 31/602
See application file for complete search history.

(56) References Cited

U.S. PATENT DOCUMENTS

| | | | | |
|---|---|---|---|---|
| 4,767,922 | A | 8/1988 | Stauffer | |
| 5,711,329 | A * | 1/1998 | Soon | E03C 1/0412 239/113 |
| 7,934,520 | B2 * | 5/2011 | Esche | F16K 31/602 137/606 |
| 9,347,207 | B2 | 5/2016 | Chen | |
| 2007/0023094 | A1 * | 2/2007 | Young | F16K 31/602 137/801 |

* cited by examiner

*Primary Examiner* — Janie M Loeppke
(74) *Attorney, Agent, or Firm* — Johnson | Dalal; Mark C. Johnson

(57) ABSTRACT

A faucet assembly that includes a base from which a spout is coupled to and protrudes from, wherein the spout is operably configured to emit a stream of liquid therefrom an offset length, b, from a spout support axis spanning through the base of the spout. The faucet assembly includes a lever handle member operably configured to rotate about a fulcrum that is offset a length, a, from the spout support axis. The lever handle member defines a length, c, separating the end of the lever handle member and the fulcrum in which the handle rotates, wherein the lever handle member is of a sufficient length, c, and operable configured to rotate a sufficient angle underneath the stream of liquid to wash and clean the handle when being utilized by the user. In one embodiment, the faucet assembly includes a relative geometric spacing configuration of $\sqrt{a^2+b^2} \leq c$.

14 Claims, 15 Drawing Sheets

File: pan fig 25 26 27 28
provisional

PAN FIG 15 ALT PROVIS 204
257
260
230
226
282

290
264
272
202
217
216
270
288
286
298
214
212
232

228

FAUCET ASSEMBLY WITH A WASHABLE HANDLE

CROSS-REFERENCE

This application claims the benefit of provisional application Ser. No. 63/205,442 filed on Dec. 10, 2020, the entirety of which is incorporated herein by reference.

BACKGROUND

The taps of bathroom faucets are usually activated by handles. Currently, handless faucet taps are predominantly located in restrooms of airports among other places. These handless faucet taps serve to significantly reduce the spread of contagious diseases that may have a devastating effect on the well-being of human beings amongst other possibilities. These faucets are not economical for most people and require maintenance by trained technicians for reliable and substantial continual and expected timely operation.

Traditional manually operated faucets in homes are usually fitted with cartridge valves requiring a handle for their activations; consequently, everyone in a home or school or locations where faucets with handles are used is exposed to being infected by handle-enabled faucets. Currently, handle-enabled faucets require that a lever be turned through a right-angle handle for activation, however, the spout is set apart from the handle. This is so because one has to get water running by turning a lever handle through a limited right angle.

Activating the lever can contaminate the lever handle with pathogens. After hands are washed for example, these same hands again are used to activate the lever in order to turn off the flow of water, consequently hands or other parts of the body may again be contaminated by the residual pathogens that initially were left on the lever before hand washing. Current faucets are not designed to wash the lever whenever hands are washed.

Varying designs of manually operated faucet valves exist; however, there is a need for a manually operated faucet enabled with a lever washable cartridge valve. For reasons of economy there is need for a lever washable cartridge faucet that is adaptable to varying designs of cartridge enabled valves. Additionally, such a design of a lever washable cartridge valve should preferably be adaptable to the increasingly creative modern faucet design features.

Additionally, the advent of globalization facilitates the rapid spread of diseases that could significantly impact world health and economies on large scale, wherein such diseases previously were localized and thus did not pose a threat to the global well-being of humanity.

Electronic eye faucet or handle-less faucet are available, e.g., as discussed in Stauffer, U.S. Pat. No. 4,767,922, Chen and U.S. Pat. No. 9,347,207. However, these faucets are not generally affordable by the global population in general and so what is needed is an economically available and reliable faucet that enables washing of the lever arm and thus mitigates the spread of diseases which can quickly become a pandemic and threaten human existence. Additionally, each use of the tap can inherently cause a showering of the lever thus mitigating the spread of pathogens in schools and other institutions and facilities where people share the use of faucets. It is conceivable that there are unknown pathogens and that there will always be the threat of life threatening pathogens at this point of global human development and beyond.

BRIEF SUMMARY

According to an embodiment of the disclosed subject matter, the invention provides greater protection against the transmission of pathogens such as the Covid-19 virus, H1N1 virus, flu virus and other transmittable pathogens and includes preferably a valve cartridge that operates efficiently while providing good flow rates.

With the foregoing and other objects in view, there is provided, in accordance with the invention, a faucet assembly with a washable handle including a faucet spout with a base, defining a spout aperture, and a median spout axis spanning through a portion of the faucet spout defining the spout aperture, wherein the faucet spout is coupled to a fluid conduit. Additionally, the assembly includes a lever handle member rotatably coupled to a valve cartridge assembly with an inlet opening defined thereon, about a fulcrum point on the valve cartridge assembly, with a distal free end, with a lever handle length, c, separating the fulcrum point and the distal free end, and operably configured to rotate at least 130° along a handle rotation plane and a handle rotation path with respect to the fulcrum point, operable configured to modulate a valve on the valve cartridge assembly to a flow position along the handle rotation path to fluidly couple the inlet opening on the valve cartridge assembly with the spout aperture and a closed position along the handle rotation path to fluidly uncouple the inlet opening on the valve cartridge assembly with the spout aperture, and operably configured to rotate along the handle rotation path, and while in the flow position, with at least a portion of the lever handle member along with the lever handle length, c, disposed underneath the spout aperture, thereby enabling a downward direction of liquid flow emitted from the spout aperture to intercept with the portion of the lever handle member.

In accordance with a further feature of the present invention, the portion of the faucet spout defining the spout aperture is enclosed.

In accordance with another feature, an embodiment of the present invention includes the faucet spout having a terminal end of the base of the faucet spout, with the fluid conduit housed within, and spanning through, the base of the faucet spout, with a fluid conduit diameter, and defining a fluid conduit axis spanning through a centroid of the fluid conduit diameter, and with a spout length, b, separating the median spout axis and the fluid conduit axis.

In accordance with another feature of the present invention, the spout aperture is disposed above the entire handle rotation plane.

In accordance with yet another feature, an embodiment of the present invention also includes a handle offset length, a, separating the fluid conduit axis and a fulcrum axis spanning through the fulcrum point in which the lever handle member is operable to rotate, wherein the faucet assembly includes a relative geometric spacing configuration of $\sqrt{a^2+b^2} \leq c$.

In accordance with a further feature of the present invention, the fluid conduit axis, the fulcrum axis, and the median spout axis are all vertically aligned with one another in a parallel orientation.

In accordance with an additional feature of the present invention, the fluid conduit axis is disposed at a 90° orientation with respect to the fulcrum axis and the median spout axis.

Also in accordance with the present invention, an improvement with a faucet assembly having a faucet spout having a base directly coupled to an upper surface of a sink, defining a spout support axis spanning through the base, defining a spout aperture dispose above the upper surface of the sink directly coupled to the base, and a median spout axis spanning through a portion of the faucet spout defining the spout aperture, wherein the faucet spout coupled to a fluid conduit coupled to the base of the faucet spout is disclosed. The improvement includes one, but preferably two, washable handle assemblies each coupled to the upper surface of the sink. The washable handle assembly may include a lever handle member rotatably coupled to a washable handle assemblies about a fulcrum point on the valve cartridge assembly defining a fulcrum axis, with a distal free end, with a lever handle length, c, separating the fulcrum point and the distal free end, with a handle offset length, a, separating the spout support axis and the fulcrum axis, the spout support axis and the fulcrum axis axially disposed in a parallel and horizontally aligned configuration, and operably configured to continuously rotate at least 90° along a handle rotation plane and a handle rotation path with respect to the fulcrum point, modulate a valve on the valve cartridge assembly to a flow position along the handle rotation path to fluidly couple the liquid source with the spout aperture and a closed position along the handle rotation path to fluidly uncouple the liquid source with the spout aperture, and rotate along the handle rotation path, and while in the flow position, with at least a portion of the lever handle member along with the lever handle length, c, disposed underneath the spout aperture, thereby enabling a downward direction of fluid flow to intercept with the portion of the lever handle member. Additionally, the improvement includes having a spout length, b, separating the median spout axis and the spout support axis, wherein the faucet assembly includes a relative geometric spacing configuration of $\sqrt{a^2+b^2} \leq c$.

In accordance with another feature of the present invention, the lever handle member is operably configured to rotate at least 130° along the handle rotation plane and the handle rotation path with respect to the fulcrum point.

In accordance with yet another feature, an embodiment of the present invention also includes the faucet spout having a terminal end of the base of the faucet spout, with the fluid conduit housed within, and spanning through, the base of the faucet spout, with a fluid conduit diameter, and defining a fluid conduit axis spanning through a centroid of the fluid conduit diameter and forming the spout support axis. Additionally, the spout length, b, separates the median spout axis 22 and the fluid conduit axis 222.

Although the invention is illustrated and described herein as embodied in a faucet assembly with washable handle, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention. The invention may also be summarized as providing a valve cartridge for a faucet and faucet assembly that includes a lever for initiating function of a faucet spout and configured to enable liquid from the spout to wash the lever. The lever has an extended length to enable positioning in the line of flow of a liquid say water. The geometrical relations of the topography of positioning in relation to the geometrical dimensions enable the washing of the lever. The lever arm is also facilitated for positioning in the line of flow of a liquid from a spout of a tap by enabling accommodating angle of turn of the lever and by enabling accommodating turning of a moveable disk in a valve cartridge.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time. Also, for purposes of description herein, the terms "upper", "lower", "left," "rear," "right," "front," "vertical," "horizontal," and derivatives thereof relate to the invention as oriented in the figures and is not to be construed as limiting any feature to be a particular orientation, as said orientation may be changed based on the user's perspective of the device. Furthermore, there is no intention to be bound by any expressed or implied theory presented in the preceding technical field, background, brief summary or the following detailed description.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the liquid flow from the spout and/or the axis of rotation about which the handle rotates.

The invention includes a handle assembly that enables the lever handle to be washed by water flowing from the spout of a bathroom faucet tap utilizing preferably a valve cartridge.

Integration of the handle assembly with the upper portion of a spindle of a cartridge valve enables the lever to intercept the downward direction of flow of water from the spout of a faucet using preferably a cartridge valve.

The invention further includes a valve cartridge for a faucet, comprising a body having an exterior surface, an interior surface defining a longitudinally extended passage extending from an inlet opening to an outlet opening and at least one side opening extending transversely through the body from the interior surface to the exterior surface.

A spindle having a lower end portion configured to fit in rotatable relationship with the interior surface of the body when situated within the passage of the body, an upper end portion that extends outwardly beyond the outlet opening of the body when the spindle is situated in the passage of the body, the lower portion having a bottom surface in which the upper portion is designed to fit within a faucet handle, a moveable disk having an upper surface configured to contact and interact with the bottom surface of the lower end portion of the spindle, an arcuate side wall portion configured to fit within the passage of the body in rotatable mirrored relationship with the interior surface of the body and an inwardly extending sidewall portion defining at least one fluid receiving area.

The receiving area is configured so that it can be rotated to align with the side opening in the body for allowing fluid flow out of the side opening of the body; a stationary disk having at least one opening, but preferably two symmetrically arranged there through for allowing passage of fluid from an inlet opening of the body through the side opening of the body when the opening in the stationary disk is aligned with the fluid receiving area in the moveable disk, the stationary disk having a side wall capable of interacting with the interior surface of the body; and a sealing ring for stabilizing and retaining the stationary disk and moveable disk within the passage of the body, the sealing ring designed with tolerance simultaneously capable of mating with the body but ensuring stability and reliability. interacting stress on its function.

The exterior surface preferably comprises at least one sealing groove for receiving a sealing component such as an O-ring. The exterior surface of the body may also be enabled with means for seating the valve cartridge within or on a fluid conduit; for example the feature may be a locking tab and the body may comprise two opposing locking tabs, The upper surface of the cartridge body at the outlet end therefore may have at least one raised stop feature thereon for limiting rotational movement of the valve cartridge when in use; for example there may be two opposing raised wedge shaped stop features.

A lower end portion of the spindle may have a groove on the exterior for receiving a seal, such as an O-ring, between the interior surface of the body and the lower end portion of the spindle.

The interior surface of the cartridge body may also have a groove near the inlet end of the body for receiving a sealing ring such as an O-ring.

The stationary disk, moveable disk or housing may be configured from ceramic.

The spindle preferably is made from metal, preferably stainless steel or brass. The upper end portion of the spindle may be enabled with means for attaching a handle.

The cartridge body preferably has two side openings and the stationary disk preferably has two openings for allowing passage of water from the inlet opening of the body then through the side openings of the body when the openings in the stationary disk are aligned with the fluid receiving area in the moveable disk.

Preferably, there are two fluid receiving areas in the moveable disk, and the stationary disk is enabled with locking mechanism that is capable of mating with a mating groove on an exterior surface of the body thus ensuring restrictive rotary motion. The preferably two opening access on the stationary disk is further aligned non-traditionally to accommodate the function of the lever assembly; the function of the lever assembly is to ensure that the lever can be enabled for washing while ensuring convenient location of the lever relative to the function and positioning of faucet parts when not in use.

The faucet assembly may have at least one valve cartridge, the assembly comprising a faucet having at least one faucet handle; a fluid conduit influenced by the faucet handle for activating the cartridge valve, a faucet body having an outlet or spout for releasing fluid at an outlet end and an inlet end in fluid communication with the fluid conduit; a base for mounting the faucet handle and faucet body; the base having an upper surface and at least one cartridge comprising a cartridge body having an exterior surface, an interior surface defining a longitudinally extending passage extending from an inlet opening to an outlet opening, and at least one side opening extending transversely through the body from the interior surface to the exterior surface.

The cartridge further has a spindle having a lower end portion configured to fit in rotatable relationship with the interior surface of the body when situated within the passage of the body and configured for integration with a lever assembly; the upper end portion further that extends outwardly beyond the outlet opening of the body when the spindle is situated in the passage of the body, the lower end portion having a bottom surface, wherein the upper end portion is configured to be fitted within a faucet handle where said faucet handle is enabled with means for independent rotation and where said faucet handle initiate turning of the spindle subsequent to turning independently before contract with the spindle.

The cartridge further has a moveable disk having an upper surface configured to contact and interact with the bottom surface of the lower end portion of the spindle, an arcuate sidewall portion configured to fit within the passage of the body in rotatable facing relationship with the interior surface of the body and an inwardly extending sidewall portion defining at least one fluid receiving area, wherein the receiving area is configured so that it can be rotated to align with the side opening in the body for allowing fluid flow out of the side opening of the body.

A stationary dish having at least one opening throughout for allowing passage of fluid from an inlet opening of the body in fluid communication with the fluid conduit, through the side opening of the body, when the opening in the stationary disk is aligned with the fluid receiving area in the moveable disk, the stationary disk having a side wall capable of interacting with the interior surface of the body; and a sealing ring for stabilizing the stationary disk and moveable disk within the passage of the body, the sealing ring capable of mating with the body.

The faucet assembly may have various embodiments for the cartridge described. In one embodiment each of the at least one cartridge body in the faucet assembly has an upper surface at the outlet end thereof having at least one raised stop feature incorporated for limiting rotational movement of the cartridge when in use, and wherein the at least one handle has a feature on an internal surface thereof that interacts with the at least one stop feature. There may be two raised wedge-shaped stop features on each of the at least one cartridge.

The relational distances between the base of the faucet spout and the base of the spindle handle a, the distance between the vertical line of fluid stream from the faucet spout and the base of the spout b and the distance be tween the vertical line of fluid stream and the base of the faucet handle c satisfy the relationship $\sqrt{a^2+b^2} \leq c$.

BRIEF DESCRIPTION OF THE DRAWINGS

The accompanying drawings, which are included to provide a further understanding of the disclosed subject matter, are incorporated in and constitute a part of this specification. The drawings also illustrate embodiments of the disclosed subject matter and together with the detailed description serve to explain the principles of embodiments of the disclosed subject matter. No attempt is made to show structural details in more detail than may be necessary for a fundamental understanding of the disclosed subject matter and various ways in which it may be practiced.

DETAILED DESCRPTION

Figure 1:
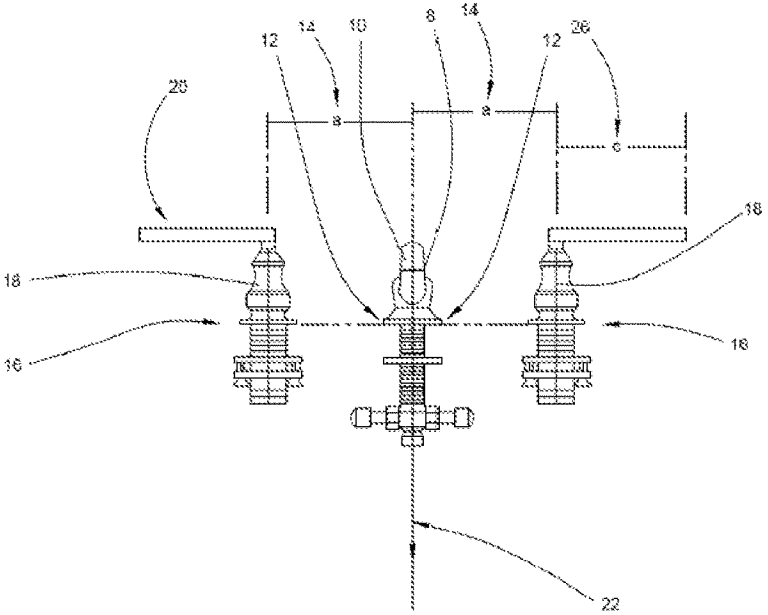
FIG. 1 shows an elevational front view of a configuration of two handles and a spout for a faucet assembly with a washable handle in accordance with one embodiment of the present invention.

Referring to FIG. 1, a geometric positioning relation of the base 12 of a faucet spout 10, and a distance 14, labeled as a, between said base 12 of said faucet spout 10, or aperture thereon, to a base 16 or median axis 18 of a fulcrum of the base 16 where the lever handle 20 is rotated. The lever handle 20 of said faucet assembly is operably configured to be rotated by, for example, a lever handle assembly 600 (depicted in FIG. 5). Specifically, said lever handle 20 is operably configured to be rotated by a connection of the lever handle 20 to an upper portion of a spindle of the cartridge valve.

Referring to FIG. 1 what is shown is a line or median spout axis 22 of vertical flow of fluid from a faucet spout portion 8 of said spout 10 of said faucet and the horizontal distance 24, labeled as b, of said line 22 of vertical flow of fluid from said spout 10 of said faucet, to the said base 12 of said spout 10 of said faucet and the said base 12 of said spout 10 of said faucet assembly. The point of intersection of line 22 of vertical flow of fluid from said spout portion 8 of said spout 10 of said faucet and the line b containing said line segment distance 24, labeled b is a projection of the geometric spatial point of spout 10 onto said line b.

Said another way, the faucet assembly with a washable handle seen in the figures includes a faucet spout 10 with a base 12, defining a spout aperture 206, and a median spout axis 22 spanning through a portion of the faucet spout 10 defining the spout aperture 206, the faucet spout 10 coupled to a fluid conduit 36. In one embodiment, the portion of the faucet spout 10 defining the spout aperture 206 is enclosed, thereby ensuring fluid flow therefrom is concentrated to flow over at least a portion of the lever handle member 20. In the preferred embodiment, the median spout axis 22 is defined by the vertical or longitudinal component of any angled or oriented spout aperture 206 that is not entirely oriented downward. The faucet spout 10 may have curved or arcuate portions and/or may be curvilinear, as conventionally shaped. In one embodiment, the spout aperture is disposed above the entire handle rotation plane 33 (as best shown with the fantom lines of the lever handle member 20 in FIG. 2).

Figure 3:
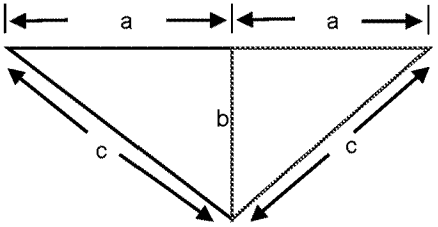
FIG. 3 shows a preferred geometric configuration of the handle, the spout, and the base of the spout for the faucet assembly with a washable handle in accordance with one embodiment of the present invention.
Figure 4:
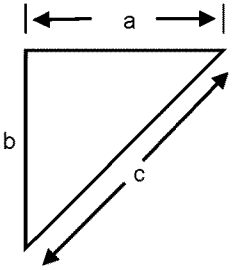
FIG. 4 shows a preferred geometric configuration of the handle, the spout, and the base of the spout for a single handle faucet assembly in accordance with one embodiment of the present invention.
Figure 2:
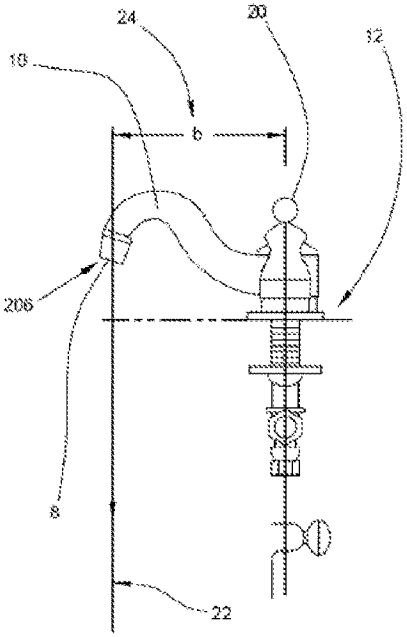
FIG. 2 shows an elevational side view of the faucet assembly with a washable handle in FIG. 1.
Figure 24:
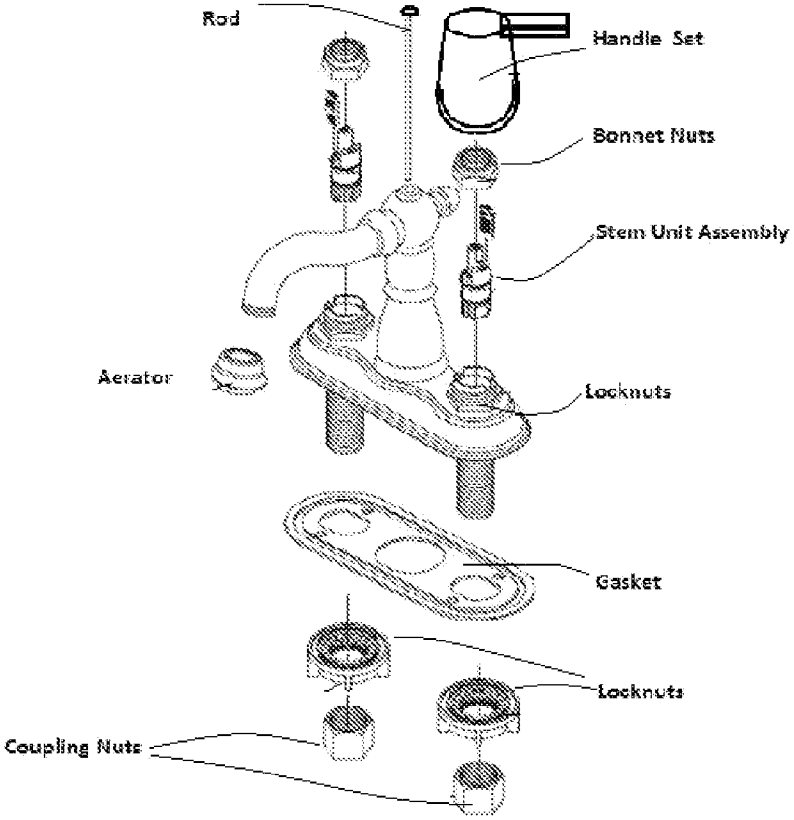
FIG. 24 shows an exploded view of a tap configured for use in a faucet assembly.
Figure 27:
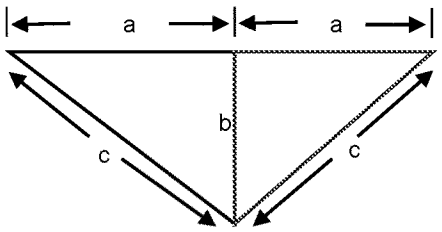
FIG. 27 shows a preferred geometric configuration of the handle, the spout, and the base of the spout for the faucet assembly with a washable handle in accordance with one embodiment of the present invention.
Figure 28:
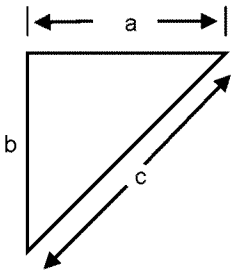
FIG. 28 shows a preferred geometric configuration of the handle, the spout, and the base of the spout for a single handle faucet assembly in accordance with one embodiment of the present invention.
Figure 26:
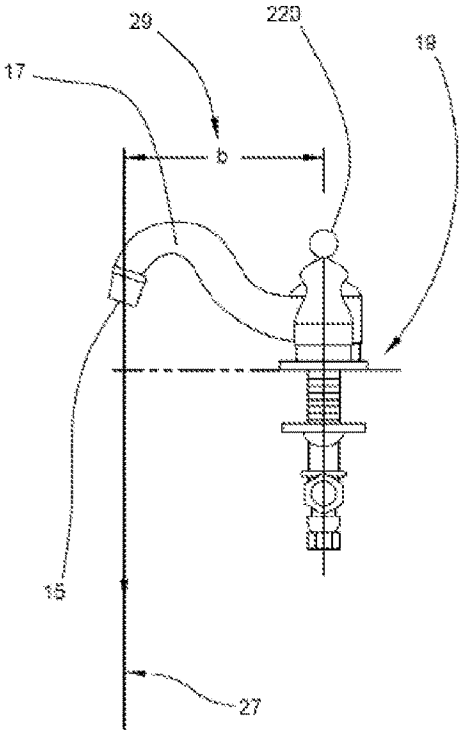
FIG. 26 shows an elevational side view of the faucet assembly with a washable handle in FIG. 25.
Figure 39:
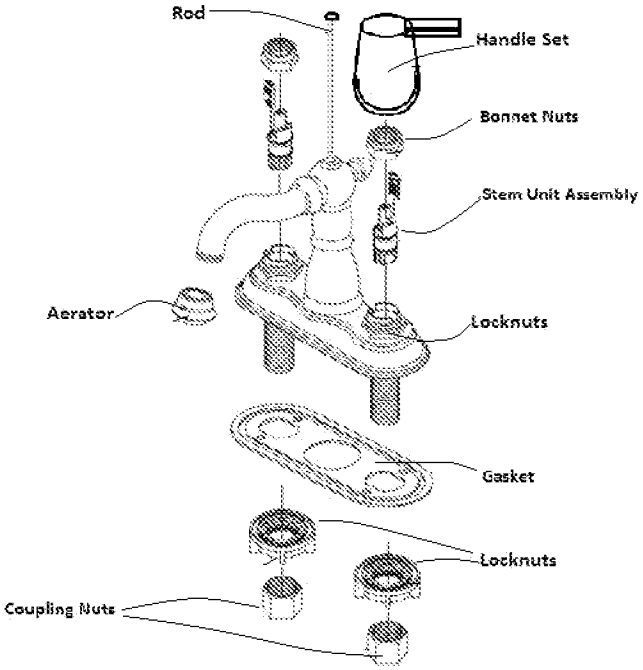
FIG. 39 shows an exploded view of a tap configured for use in a faucet assembly.

With reference to FIGS. 1-2 and FIG. 24, the faucet spout 10 may also include a terminal end 208 of the base 12 of the faucet spout 10 that may be directly coupled to a sink upper surface (e.g., schematically represented with numeral 35) using, for example, locknuts 2402 disposed on the base 12, an upper fastener or nut 2404, a gasket 2406, a locknut 2408, and a lower fastener or nut 2410. This is similarly shown for the alternative embodiment depicted in FIG. 39. The fluid conduit 36 may be housed within, and spans at least partially through, the base 12 of the faucet spout 10. The fluid conduit 36, which may be circularly or another shape, may have a fluid conduit diameter or inner diameter and defines a fluid conduit axis 222 spanning through a centroid of the fluid conduit diameter, wherein the faucet spout 10 includes a spout length, b, separating the median spout axis 22 and the fluid conduit axis 222. Said different, the faucet spout 10 may include a length in which the faucet spout 10 protrudes outwardly from the base 12 a spout length, b. As known with most spouts, however, the faucet spout 10 may also protrude upwardly from the base 12 as well.

The terminal end 208 of the base 10 of the faucet spout 10 that couples to the sink may also define an axis from which the spout may protrude outwardly over the cavity and/or drain of the sink. This axis may be defined by a fluid conduit 36 housed within, and spanning through, the base 12 of the faucet spout 10, wherein the fluid conduit 36 may include a fluid conduit diameter and a defined fluid conduit axis 222 spanning through a centroid of the fluid conduit diameter. To that end, a spout length, b, may separate the median spout axis 22 and the fluid conduit axis 222, i.e., how much the spout aperture is offset from a portion of the base 12 aligned with a fulcrum axis 37.

Figure 11:
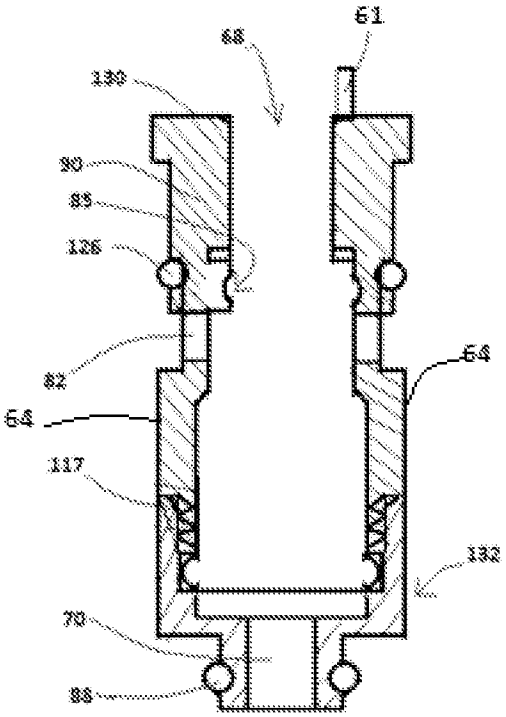
FIG. 11 shows a cross-sectional view of an embodiment of a cartridge body in accordance with one embodiment of the present invention.

The lever handle member 20 is rotatably coupled to a valve cartridge assembly 604, wherein the valve cartridge assembly 604 may include a fluid source conduit or inlet opening 70 (shown best in FIG. 11). The lever handle member 20 is rotatable about a fulcrum point on the valve cartridge assembly 604 and may include a distal free end 134 in which the lever handle member 20 terminates. The lever handle member 20 includes a lever handle length, c, separating the fulcrum point and the distal free end 134. The lever handle member 20 may include the fulcrum axis 37 spanning through the fulcrum point in which the lever handle member 20 is operable to rotate, wherein a handle offset length, a, can be seen separating the fluid conduit axis 222 and the fulcrum axis 37.

Said differently, one or more washable handle assemblies may be coupled to the upper surface of the sink, wherein each of the handle assemblies may include a lever handle member 20 rotatably coupled to a valve cartridge assembly 604 with an inlet opening 70 defined thereon and fluidly coupled to a liquid source (schematically represented with block 1100 in FIG. 11), about a fulcrum point on the valve cartridge assembly defining a fulcrum axis, with a distal free end 134, with a lever handle length, c, separating the fulcrum point and the distal free end 134, with a handle offset length, a, separating the spout support axis and the fulcrum axis 37. The spout support axis and the fulcrum axis axially disposed in a parallel and horizontally aligned configuration, and the lever handle member may be beneficially operably configured to continuously (without interruption) rotate at least 90° along a handle rotation plane 33 and a handle rotation path (represented with arrow 2400) with respect to the fulcrum point and modulate a valve on the valve cartridge assembly 604 to a flow position along the handle rotation path 2400 to fluidly couple the liquid source (e.g., building water source) with the spout aperture 206 and a closed position along the handle rotation path 2400 to fluidly uncouple the liquid source with the spout aperture 206. Further, the lever handle member 20 is operably configured to rotate along the handle rotation path, and while in the flow position, with at least a portion of the lever handle member 20 along with the lever handle length, c, disposed underneath the spout aperture 206, thereby enabling a downward direction of liquid flow to intercept with the portion of the lever handle member 20. Further, the assembly includes a spout length, b, separating the median spout axis 22 and the spout support axis 222, wherein the faucet assembly includes a relative geometric spacing configuration of $\sqrt{a^2+b^2} \leq c$.

Beneficially, the lever handle member 20 may be operably configured to rotate at least 130° along a handle rotation plane 33 and a handle rotation path (represented with arrow 2400) with respect to the fulcrum point and configured to modulate a valve on the valve cartridge assembly 604 to a flow position along the handle rotation path 2400 to fluidly couple the inlet opening 70 on the valve cartridge assembly 604 with the spout aperture 206 and a closed position along the handle rotation path 2400 to fluidly uncouple the inlet opening 70 on the valve cartridge assembly 604 with the spout aperture 206. Further, the lever handle member 20 is operable to rotate along the handle rotation path 2400 such that at least a portion of the lever handle member 20 along with the lever handle length, c, is disposed underneath the spout aperture 206 while in the flow position, thereby enabling a downward direction of fluid flow to intercept with the portion of the lever handle member 20 and remove any debris and/or bacteria (when a disinfectant is applied). This enables the handle to be cleaned or washed on every instance of use, thereby minimizing the proliferation of bacterial or viral spread.

Referring to FIG. 1, the geometric length 26 labeled c, of said handle lever 20 can be related to the said geometric distance, a, and said geometric distance, b, by the inequality $\sqrt{a^2+b^2} \leq c$. When said relation $\sqrt{a^2+b^2} \leq c$ exists in said faucet said lever handle 20 can be enabled to intersect said line of fluid flow 22 from said spout portion 8 of spout 10 of said faucet; thus said lever portion 20 can be exposed to interact with said fluid flowing from said spout portion 8 of said spout 10. Said differently, the faucet assembly beneficially includes a relative geometric spacing configuration of $\sqrt{a^2+b^2} \leq c$. To that end, the fluid conduit axis 222, the fulcrum axis 37, and the median spout axis 22 are all vertically aligned with one another in a parallel orientation (as seen best in FIGS. 1-2). Additionally, the fluid conduit axis 222 may be disposed at a 90° orientation with respect to the fulcrum axis 37 and the median spout axis 22.

Figures 5, 6, 7:
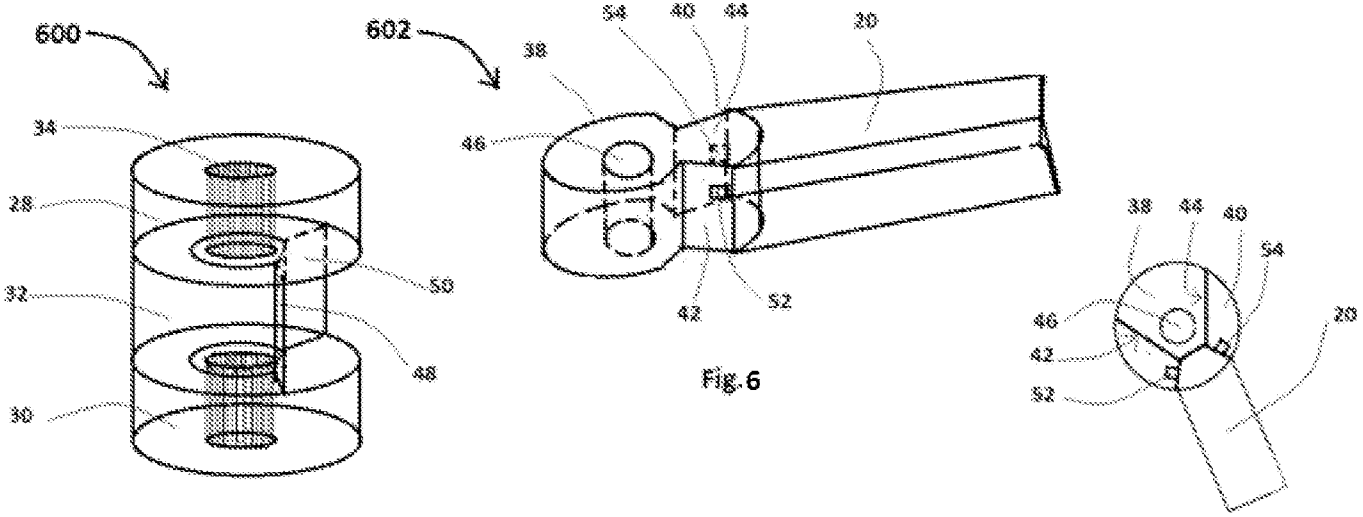
FIG. 5 shows a configuration of a handle assembly without a lever handle in accordance with one embodiment of the present invention.
FIG. 6 shows an exemplary lever handle in accordance with one embodiment of the present invention.
FIG. 7 shows a top plan view of the lever handle assembly in FIG. 6.

Referring to FIG. 5, a lever assembly component is shown that preferably comprises a solid cylindrical upper portion 28, a lower solid cylindrical portion 30. Said upper solid cylindrical portion 28 and said lower solid cylindrical portion 30 are firmly attached to the solid portion 32, wherein said portion 32 may have a uniform cross-section where said uniform cross-section is shaped from the annulus of two concentric circles in a plane and where said concentric circles are of unequal radius.

The radius of upper portion 28 and the radius of lower portion 30 of said component 28 and said component 30 may be that of the more substantial radius of uniform cross-section 32. The center of said 28, 30 and 32 conform to stacking of common concentric centers of circles with substantially a common radius.

Said cylindrical solids 28 and 30 of component 600 may be enabled with access openings 34 on the upper and lower surfaces on the solids 28, 30 thereon, wherein said interior access wall of said access openings 34 may be enabled with means for gripping. The gripping can be enabled by a rectangular or other shaped access slot of said openings 34, or a vertically serrated interior wall of said access openings 34.

Figure 12:
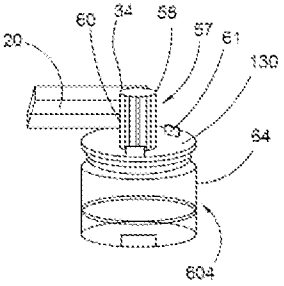
FIG. 12 shows a valve cartridge in accordance with one embodiment of the present invention.
Figure 17:
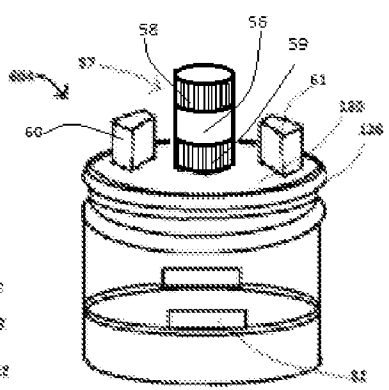
FIG. 17 shows a related position of stop features and outlets for the cross-sectional view in FIG. 16.
Figure 16:
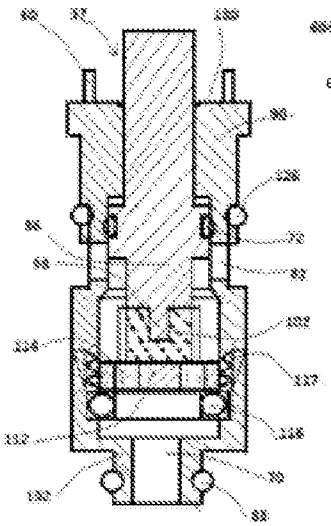
FIG. 16 shows a cross-section view of a valve cartridge perpendicular to the cross-sectional view in FIG. 15.
Figure 15:
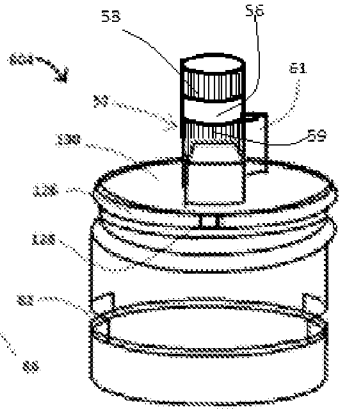
FIG. 15 shows a related position of stop features and outlets for the cross-sectional view in FIG. 14.
Figure 14:
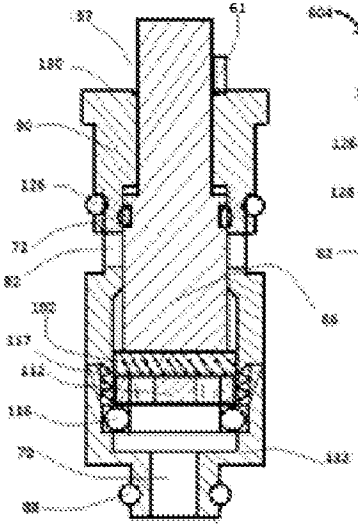
FIG. 14 shows a cross-sectional view of a valve cartridge in accordance with one embodiment of the present invention.

Referring to the hand lever portion 602 of FIG. 12, an end portion of the lever handle member 20 is shown that preferably includes a solid with a uniform cross-sectional area. Said cross-sectional area may be characterize as having two stacked arcuate portions 38, 40. Said arcuate portions 38, 40 may be contiguous at a common cross-sectional area. Said side faces 42 of arcuate 40 may be preferably enabled with flange 52 and said side face 44 of said arcuate 40 may preferably and beneficially be enabled with a flange 54. Said interior wall of access slot 46 is substantially smooth enabling substantially unimpeded motion of motion over said interior wall defined by said access slot 46. Said interior wall of access slot 46 may be enabled with means for minimizing friction.

Figure 9:
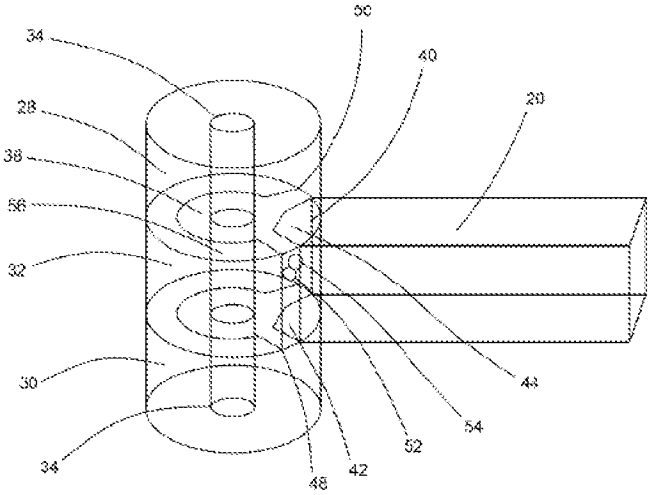
FIG. 9 shows the handle assembly configured with its lever assembly coupled thereto.

As shown in FIG. 9, the center of said components 28, 30 and 32 and 46 conform to stacking of common concentric centers of circles with substantially a common radius, thus the slots 34 and 46 are substantially congruent.

Said component 202 is operably configured to rotate a predetermined angle by turning handle lever 20, thereby subsequently enabling interaction with face 48 of component 32 by flange 52 in an apparent clockwise direction. Alternatively, said component 202 may be enabled to rotate by turning handle lever 20, thus enabling interaction with face 50 of component 32 by flange 54 in an apparent counterclockwise direction. Activation of said lever arm to turn enables opening or closing of a cartridge valve. The delay angle component enables convenient positioning of said lever angle when said faucet is not being used.

Said component 38 is designed to rotate a predetermined angle prior to engaging and interacting with component 32. As depicted in FIG. 7, a graphical representation is shown indicating a position of the lever prior to flange 52 of face 42 of arcuate 40 engaging face 48 of component 32 when said lever arm 20 is turned.

Figure 8:
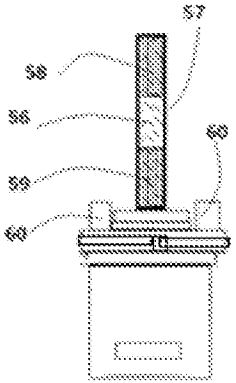
FIG. 8 shows a valve cartridge configured with a spindle for use with the lever handle assembly in FIG. 6.

Referring to FIG. 8, an exemplary valve cartridge 604 is depicted. Said valve cartridge 604 depicted in FIG. 8 may include a spindle 57, wherein an upper portion 57 of the spindle 57 includes portions 58 and portion 56.

A spindle 57 is also part of the cartridge, wherein said upper portion 57 is configured to fit in rotatable relationship with the interior access 34 of lever assembly 600 and the interior access 46 of lever component 602.

Said upper portion 58 of spindle 57 is also enabled with means for attaching and interacting with lever assembly 600. Said portions 58 of upper portion 57 may be serrated for gripping with access 34 of component 600.

Said upper part 56 of spindle 57 are operably configured a with means for allowing neutral motion of said spindle when said handle lever is turned through a pre-determined angle and said component portion 56 of spindle 57 is completely vertically enclosed by circular portion 46 of said lever handle. Thus said portion 56 of spindle 57 is substantially smooth. Said exterior wall portion of 56 may be enabled with means for minimizing friction.

Figure 20:
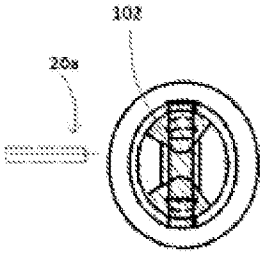
FIG. 20 shows a fixed disk configured with the moveable disk in the off position.
Figure 21:
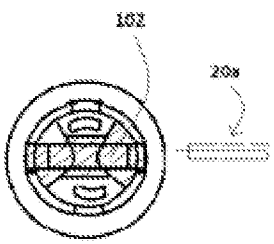
FIG. 21 shows a fixed disk configured with the moveable disk in the on position.

Said lever handle component 46 thus fully encloses portion 56 of said spindle 57 and consequently enables substantially unimpeded relative circular motion of lever component 602 when access slots 34 and 46 are stacked on said spindle as depicted in FIG. 20.

Said neutral motion of said spindle may be enabled when said portion 56 of upper portion 57 of spindle said spindle is substantially smooth thus substantially disallowing motion relative motion of said spindle where said such motion restrict motion of said ring portion relative to said spindle.

Said angle of turn of component 38 is designed to rotate a predetermined angle prior to engaging and interacting with component side faces 48 of 32; said predetermined angle of turn of said component 38 is enabled when said lever handle 20 is initiated to turn preferably clockwise thereby enabling flange 52 of lever handle component to turn a predetermined angle prior to engaging face 48 of component 32 and where said portions 58 of spindle 57 is firmly locked in slot 34 of component 200. Such locking means may be enabled by a serrated locking means between spindle portion 58 and interior wall of circular slots 34. Alternatively, such locking may be enabled by rectangular slots. Said turning of lever through a predetermined angle is substantially insignificant in time to initiation of liquid flow from said spout portion 8; said time to initiation of flow of liquid from said spout 8 is directly proportional to the radius and rate of angular displacement; said lever dimension and angular rate of displacement enables time to initiation of flow from spout 8 substantially insignificant.

When said lever handle 20 is turned and said lever handle component flange 52 has turned substantially unopposed through a predetermined angle, said flange 52 may be initiated to contact face 48 of component 32 which in turn enables activation of the spindle 57. Tabs, 60, on the body of the cartridge 604 influences the turning of said lever. Said tabs 60 may define an angular range for the turning of said lever 20 thus when said lever handle 20 is rotated said turning of the lever enables said lever handle is enabled to pass the vertical line of flow 22 from the spout portion 8 of faucet spout 10 and thus enables showering of the said lever 20.

As shown in FIG. 8, the invention includes a valve cartridge, generally referred to as cartridge 604, for a faucet, when in use as part of a faucet assembly such as assembly 600 shown in FIG. 5. The cartridge 604, includes a body 90 which has an exterior surface 64 and an interior passage 68. As shown the exterior surface is preferably generally cylindrical in shape so as to be easily situated in a flow conduit for fluid to act as an inline valve between the conduit and the outlet of a faucet. The body may be formed of a variety materials such as metal, metal alloys or other utility compatible economical nonmetallic composite or thermoplastic.

As shown in FIG. 6, the invention includes a valve cartridge, generally referred to as cartridge 604, for a faucet. The cartridge 604, includes a body 62 which has an exterior surface 64 and an interior substantially cylindrical 68. As shown the exterior surface is preferably generally cylindrical in shape so as to be easily situated in a flow conduit for fluid to act as an inline valve between the conduit and the outlet of a faucet. The body may be formed of a variety materials such as metal, metal alloys or other utility compatible economical nonmetallic composite or thermoplastic.

As shown in FIG. 5, a spindle 57 is also part of the cartridge. Said spindle 57 has an upper portion 58 configured to fit in rotatable relationship with the interior surface 34 of lever assembly 20, and with the lower portion 66, of the body 90 when situated within the passage 68 of the body 90.

The interior passage 68 of the body 90 defines a longitudinally extending passage 68 through the body, as shown in FIG. 11. The passage 68 preferably extends from an inlet opening 70, at the bottom of the body to a lateral outlet opening 82 at the top of the body.

The passage 68 preferably has a cylindrical configuration conducive to use of rotating parts therein and can also have one or more sections or ones to accommodate the size and shape of various parts therein. As shown the passage has an upper portion 76 which is preferably of a narrower cross-sectional diameter as shown in FIG. 11 to correspond to the dimensions of the spindle 57, and a lower wider cross-sectional diameter section 78 that is preferably wider to accommodate other parts of the valve such as a disk, sealing rings and rotatable base portion of the spindle.

The body further includes at least one side opening 82 extending transversely through the body from the interior passage 68 to the exterior surface of the body 90. The side opening 82 is preferably located to be compatible with traditional faucet design in that water or other fluid flowing upwards through the inlet end 70 of the body into passage 68 would encounter the stationary disk and pass through the opening therein when in the open valve mode until it entered the receiving area of the moveable disk and could then flow out the side opening 82 in the body to continue on to feed the faucet body and outlet of the faucet.

Thus the side opening 82 for this embodiment should preferably be positioned to accommodate that flow in an unimpeded manner within the design. The opening is preferably rectangular for fluid flow characteristics but can have other configuration in order to meet some design or aesthetics. As shown two such side openings 82 are shown which is compatible with the number of openings and receiving areas in the disk cartridge.

The spindle 57 of cartridge 604 has a lower portion 86 which is configured to fit in rotatable relationship with the interior passage 68 of the body 90 when situated within the passage 68 of the said body 90. As shown the lower portion of the spindle sits within the passage and has one or more seals to prevent leakage around the spindle. One O-ring 72 is placed above the lower end portion 86 of the spindle 57, which as shown in this embodiment is somewhat wider than the rest of the spindle and sits within a groove 85 in the lower end portion 86 of the spindle 57, which is situated in the lower portion 78 of the passage 68 of the body 90. The lower end portion of the spindle preferably has such a groove on its exterior surface for receiving a seal such as O-ring capable of providing sealing engagement between the interior surface of the body and the lower end portion of the spindle. The upper end portion of the spindle may preferably have a threaded or other snap-fit, slide in fit, friction fit or gripping surface for attaching the cartridge to a faucet handle so as to be rotatable and function with the handle. The lower end portion 86 of the spindle 57 has a bottom surface 96. The upper end portion 58 of the spindle 57 as shown in FIG. 10 is configured to be fitted within a faucet handle 20 assembly.

Figure 10:
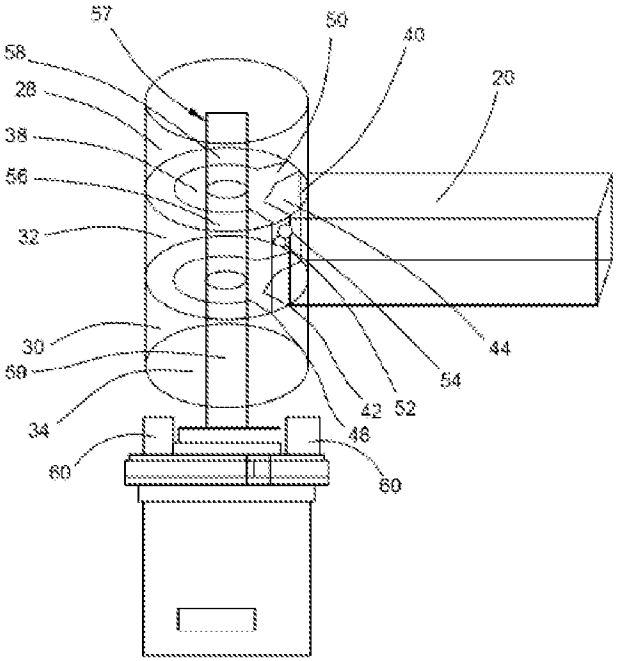
FIG. 10 shows the spindle of a cartridge configured with a lever assembly.

The bottom surface 96 preferably has a feature which allows for interaction with a movable disk so that when the upper portion 57 of the spindle is fitted within a faucet handle assembly 20 depicted in FIG. 10 and turned a predetermined angle, it will then in turn, turn the moveable disk and activate the open/close feature of the cartridge.

Figure 13:
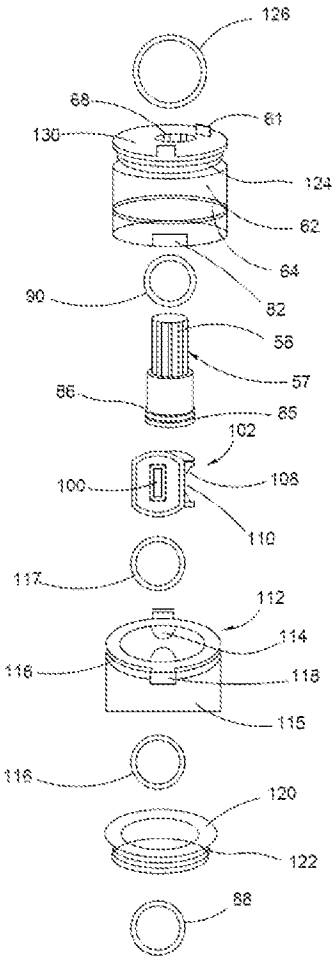
FIG. 13 shows an exploded view of component parts of a valve cartridge in accordance with one embodiment of the present invention.

The rotational movement of the spindle in response to the faucet handle when interconnected and/or interacting with the moveable disk effects opening/closing operation of the cartridge. Thus, some feature to allow such rotational interaction with said spindle when said spindle 57 is in turning. As preferred, the bottom surface 96 has a tab or opening therein which can interlock with a matching tab or opening in the moveable disk. A tab 98, preferably rectangular prism in shape fits in a slot 100 in a moveable disk 102 shown in FIG. 13 so that turning of a faucet handle interacting with a spindle 57, turns the said spindle 57 that also turns the moveable disk 102 for opening and closing the cartridge valve. The spindle may preferably be formed from metal or other material ensuring structural integrity and safe for coming in contact with drinking water. The spindle may be formed of a one piece construction, wherein the whole spindle is formed of stainless steel or other safe metal or wholly of a plastic material.

The moveable disk 102 included within the body in the passage 68 is enabled with means on its upper surface 104 configured to contact and interact with the bottom surface 96 of the lower end portion of the spindle 86 in a rotatable relation. As shown, the upper surface 104 is preferably configured with a slot 100 for receiving a tab 98 therein. The disk upper surface may preferably be defined as a portion of the cross-section of a solid cylinder defined by symmetrically parallel chords shaped to fit within a preferred generally cylindrical portion of the passage 68 in the lower portion 78 in the passage 68. There is preferably two side wall portion 108 defining preferably two fluid receiving area 110 within the moveable disk 102. The receiving area 100 is configured so that when the disk 102 is rotated to align the receiving area 100 with the side opening 82 in the body 68 it will allow fluid flow out of the side opening of the body for feeding the faucet to which to is installed with fluid entering the cartridge from a conduit through the open inlet 70 of the cartridge.

A stationary disk 112 is also included in the design that works with the moveable disk by providing at least one opening 114 extending through the stationary disk 112 for allowing passage of fluid flow from an inlet end 70 of the body 90 entering the passage 68, then through the stationary disk and into the receiving area 110 of the moveable disk, and then out the side opening 82 of the body when the cartridge is in the open position mode. The stationary disk 112 is enabled with a feature 115; the function of feature 115 will subsequently become apparent in this application Thus when the opening 114 in the stationary disk is aligned with designed so as to fit within faucet handle is turned to reduce and shut off flow; the handle thus initiates the closing of the valve when said handle is initiated to turn in the valve closure turning mode to the off position.

In further embodiments of the invention, an upper surface 130 at the outlet end 74 of the said body 90 may also have means for limiting the rotation of handle 20. or more stops feature. For example preferably two stop feature may be placed on the upper face 130 for limiting rotational movement of the valve cartridge when in use and actuated by a faucet. This helps for smooth faucet use, limited range of motion consistent with disks openings and a desired mating of the various flow openings within a particular predetermined rotational range. As shown in FIG. 12, two raised stop features 60 and 61 are shown.

Said stop features 60 and 61 enabled on said upper surface 130 are arranged such that with the center of a circle lying on the axis of rotation of spindle 57, said stop features location 60 and 61 may characterize end points on separate radii where said radii originate from a common point lying in the plane of surface 130 on the axis of rotation of spindle 57.

Liquid is enabled to flow through portion 8 of spout 10 of faucet assembly depicted in FIG. 1 when the angle of turn of said moveable disk 102, relative to said fixed disk 112, rotates through an arc defined by the point of initial activation of face 48 by flange 52 and the point position of stop feature 61 on surface 130. Said center of arc originate from a point lying on the axis of rotation of spindle 57.

Said angle of turn of said moveable disk 102 relative to said fixed disk 112 moves simultaneously and in unison with the angle defined by the point of initial activation of face 48 by flange 52 and the point position of stop feature 61 on surface 130 when lever arm 20 is activated to turn in a plane parallel to the plane of surface 130 ; thus enabling positioning of lever arm 20 to intercept the line of flow from spout portion 8 of spout 10. Said rotation of component handle 20 of assembly 600 is designed to be limited by wedges 61. The angle defined by the point of initial activation of face 48 by flange 52 and the point position of stop feature 61 on surface 130 is preferably an obtuse angle.

Thus turn of handle 20 subsequently enable turn of spindle 57 thus enabling opening and closing of valves and thus enables lever handle to be washed by fluid when said faucet is activated for its function. Thus each use of the tap can inherently cause a showering of the lever thus mitigating the spread of pathogens; said inherent showering of the lever 20 is enabled because said lever arm 20 moves through an angle in a horizontal plane that is greater than the angle turned to the said line of flow 22 thus the inherent showering is enabled when the initial angle of turn of the lever to get liquid flowing along line of flow 22 is reversed to enable positioning of lever arm back to a rest positioning in which flow of liquid is disabled.

Figure 18:
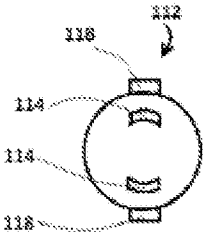
FIG. 18 shows a top plan view of a configuration of a fixed disk in accordance with one embodiment of the present invention.
Figure 19:
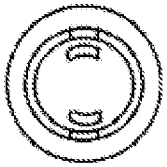
FIG. 19 shows a configuration of the fixed disk within the passage of the cartridge.
Figures 22, 23:
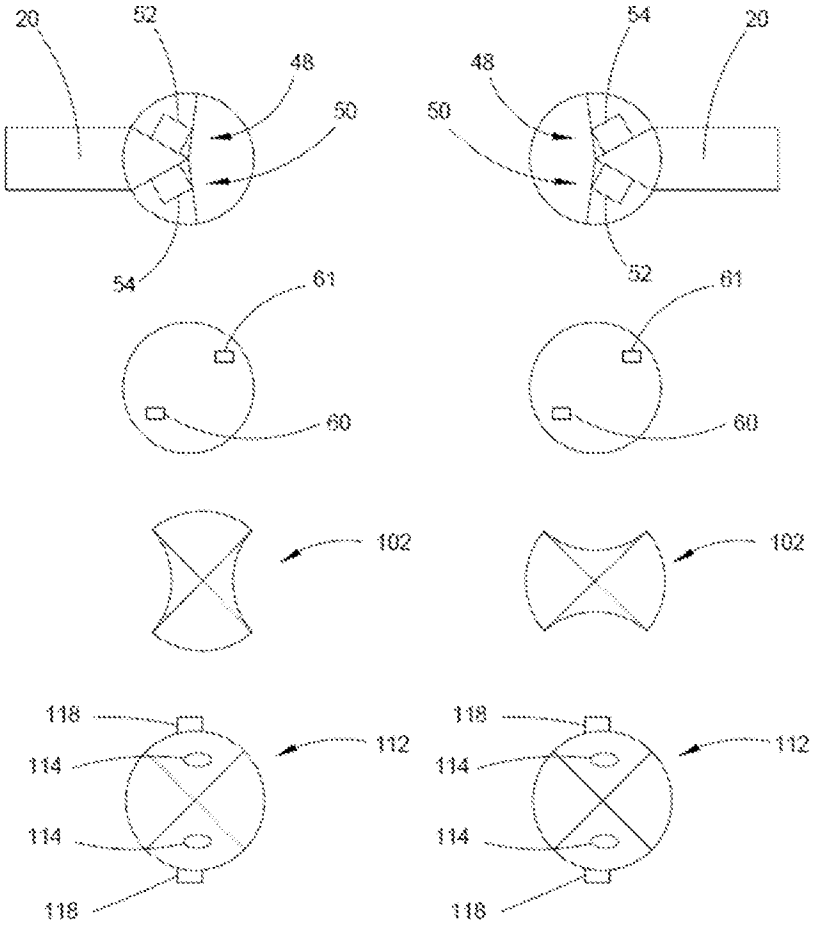
FIG. 22 shows an exploded view depicting an order of contiguous assembly and relative orientation of the handle depicted in FIG. 18, the position of tabs, the orientation of the moveable disk and the stationary disk when faucet system is in the off mode but disposed to enable flow of liquid to said faucet when activated.
FIG. 23 shows an exploded view of an order of contiguous assembly and relative orientation of the handle depicted in FIG. 18, the position of tabs, the orientation of the moveable disk and the stationary disk when faucet system is in the on mode.

Referring to FIG. 22, an order of contiguous assembly and relative orientation of the handle 20 depicted in FIG. 9 is shown, wherein the position of tabs 60, the orientation of the moveable disk 102 and the stationary disk 112 when faucet system is in the off mode or closed position along a handle translation path, but is disposed to enable flow of liquid from the liquid source to said faucet, or aperture thereon, when activated, i.e., a flow position Referring to FIG. 23, an order of contiguous assembly and relative orientation of the handle 20 of 606 depicted in FIG. 18 is shown, wherein the position of tabs 60, the orientation of the moveable disk 102 and the stationary disk 112 when faucet system is in the turned on mode and liquid flow is enabled and thus flows to said faucet.

The stationary disk 112 is enabled with means for ensuring stability and reliability of the faucet system; said means for stability may be achieved by inclusion of locking tabs 118; said tab 118 can be designed to fit within similar openings on the interior passage 68 of the body 90; said tab 118 may be an abutment of the side wall of stationary disk 112 preferably capable of interacting with the interior passage 68 of the body 90 so as to help stabilize the disk 112 in place and with other parts within the body. As there may be more than one side opening 82 in the body 90, and more than one receiving area 110 in the moveable disk, then there may also be more than one opening 114 in the stationary disk to accommodate flow.

A sealing O-ring 116 is included within component 132 and functions to apply pressure between 132 stationary valve member 102, and rotary valve member 112. The pressure exerted by O-ring 116 ensures optimal functioning of the cartridge for flow of liquid. The stationary disk is enabled with a feature 115 that increases the velocity of fluid through openings 114 of the stationary disk thus reducing pressure on the sealing zone of O-ring 116.

For seating the cartridge, it is also preferred that the body further includes an outer seal for seating the cartridge on installation in a fluid conduit. Such sealing may be accomplished by providing a sealing groove 124 on the exterior surface 68 of the body for receiving a seal, such as an O-ring 126. The exterior surface 66 of the body 68 may also preferably include at least one feature, preferably a locking tab or snap fit mechanism on its upper outlet end portion on or near the outlet 68 of the body for use in seating the valve cartridge within or on a fluid conduit enabled with a mating feature. As shown a locking tab 118 is shown that can interlock with a receiving opening in a conduit. However, other locking or stabilizing features can also be used as desired. Two or more of such locking tabs, including two opposed locking tabs may be provided within the scope of the invention. An O-ring 88 fits around the lower surface of the body inlet 70; said O-ring 88 helps to provide a fluid resistive seal between the faucet body 90 and the inlet 70. O-ring 117 provides a fluid resistive seal on the outer surface of the body 90 and positioned between body 90 and inlet assembly 132.

Other features and advantages will become apparent from the following description preferably n taken relative to the accompanying drawings, which in combination discloses an embodiment of the invention.

Additional features, advantages, and embodiments of the disclosed subject matter may be set forth or apparent from consideration of the following detailed description, drawings, and claims. Moreover, it is to be understood that both the foregoing summary and the following detailed description are illustrative and are intended to provide further explanation without limiting the scope of the claims.

Figure 25:
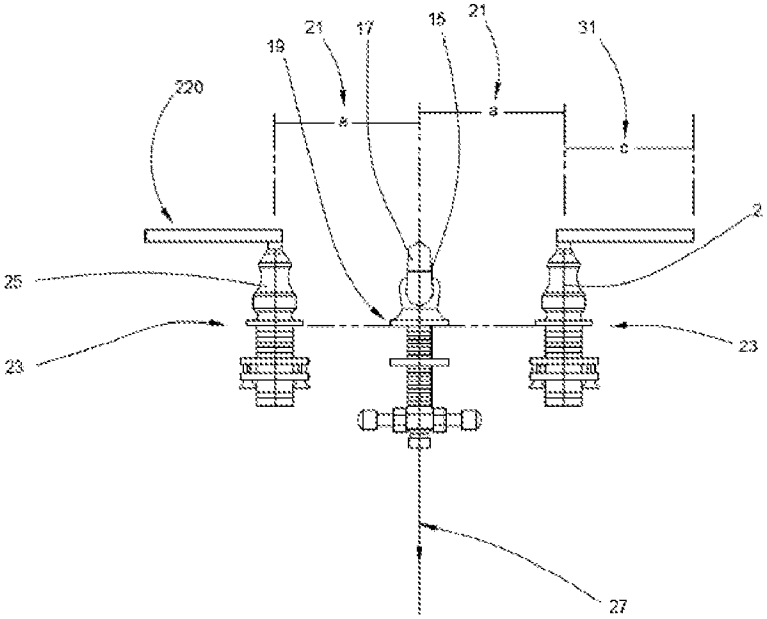
FIG. 25 shows an elevational front view of a configuration of two handles and a spout for a faucet assembly with a washable handle in accordance with another embodiment of the present invention.

Referring to FIG. 25, an alternative embodiment of the invention is depicted. Specifically, a geometric positioning relation of the base 19 of a faucet spout 17, and distance 21, labeled as, a, of said base 19 of said faucet spout 17 from said base 19 of spout 17 to a base 23 of a lever handle 220 of said faucet, wherein said lever handle 220 is enabled with means for rotational motion. Said lever handle rotation being enabled by connection to the upper portion of a spindle of the cartridge valve 204.

Referring to FIG. 25, what is shown is a line 27 of vertical flow of fluid from a faucet spout portion 15 of said spout 17 of said faucet and the horizontal distance 29, labeled b, of said line 27 of vertical flow of fluid from said spout 17 of said faucet, to the said base 19 of said spout 17 of said faucet and the said base 19 of said spout 17 of said faucet. The point of intersection of line 27 of vertical flow of fluid from said spout portion 15 of said spout 17 of said faucet and the line b containing said line segment distance 29, labeled b is a projection of the geometric spatial point of spout 17 onto said line b.

Referring to FIG. 25, a geometric length 31 labeled as, c, of said handle lever 220 can be related to the said geometric distance, a, and said geometric distance, b, by the inequality $\sqrt{a^2+b^2} \leq c$. When said relation $\sqrt{a^2+b^2} \leq c$ exists in said faucet, said lever handle 220 can be enabled to intersect said line of fluid flow 27 from said spout portion 15 of spout 17 of said faucet; thus said lever portion 220 can be exposed to interact with said fluid flowing from said spout portion 15 of said spout 10.

Figure 29:
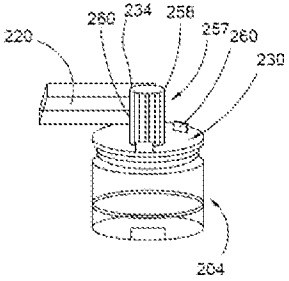
FIG. 29 shows a configuration of a valve cartridge with a lever handle in accordance with one embodiment of the present invention.

Said lever handle component 220 depicted in FIG. 29 is firmly locked in portions 258 of spindle 257. Such locking means may be enabled by a serrated locking means between spindle portion 258 and interior wall of circular slots 34 of said handle 220. Alternatively, such locking may be enabled by rectangular slots.

Tabs, 260, on the body of the cartridge 204 influences the turning of said lever. Said tabs 260 may define an angular range for the turning of said lever 220 thus when said lever handle 220 is rotated said turning of the lever enables said lever handle is enabled to pass the vertical line of flow 27 from the spout portion 15 of faucet spout 17 and thus enables showering of the said lever 220.

As shown in FIG. 29, the invention includes a valve cartridge, generally referred to as cartridge 204, for a faucet. The cartridge 204, includes a body 290 which has an exterior surface 264 and an interior substantially cylindrical passage 268. As shown the exterior surface is preferably generally cylindrical in shape so as to be easily situated in a flow conduit for fluid to act as an inline valve between the conduit and the outlet of a faucet. The body may be formed of a variety materials such as metal, metal alloys or other utility compatible economical nonmetallic composite or thermoplastic.

Figure 31:
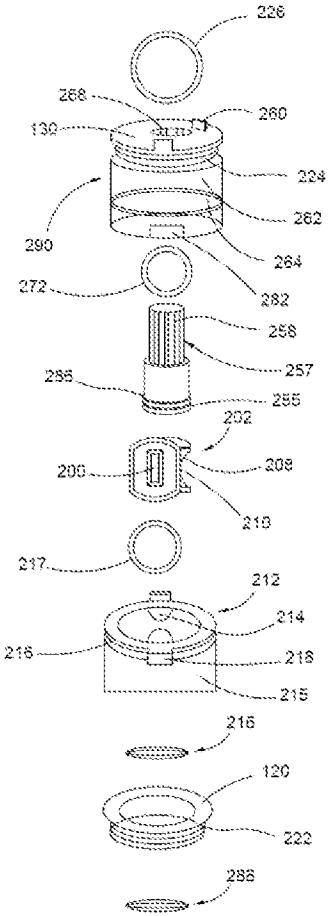
FIG. 31 shows an exploded view of a configuration of the parts of a valve cartridge in accordance with one embodiment of the present invention.

As shown in FIG. 29, a spindle 257 is also part of the cartridge. Said spindle 57 has an upper portion 258 configured to fit in rotatable relationship with the interior surface 234 of lever assembly 220, and with the lower portion 86 configured to fit in the passage at the lower end of the body 290 when situated within the passage 268 of the body 290 as shown in FIG. 31.

Figure 32:
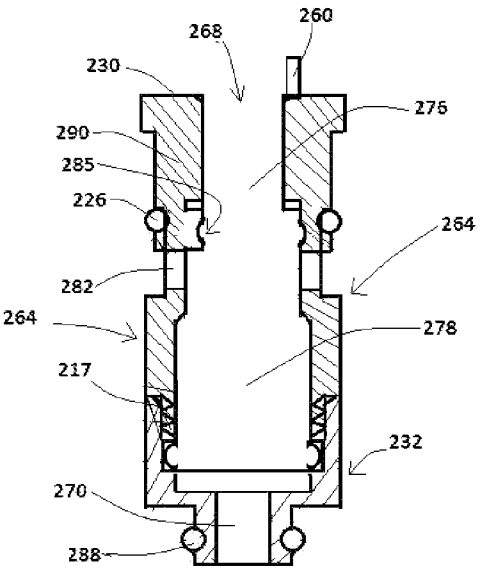
FIG. 32 shows a cross-sectional view of a cartridge body in accordance with one embodiment of the present invention.
Figures 33, 34, 35, 36:
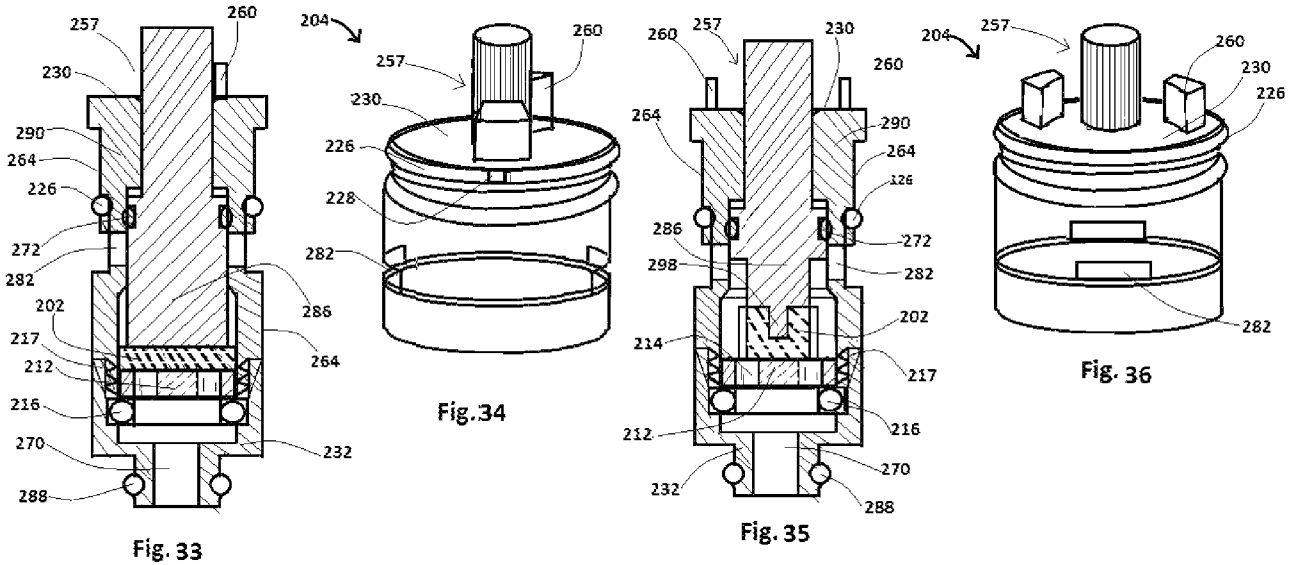
FIG. 33 shows a cross-section of an embodiment of a cartridge body in accordance with one embodiment of the present invention.
FIG. 34 shows a valve cartridge configuration related to the cross-sectional view of FIG. 33.
FIG. 35 shows a section of the valve cartridge perpendicular to section of FIG. 33.
FIG. 36 shows a valve cartridge configuration related to section of FIG. 35.

The interior passage 268 of the body 290 defines a longitudinally extending passage through the body as shown in FIG. 32. The lower part 278 of passage 268 preferably extends from an inlet opening 270, at the bottom of the body to a lateral outlet opening 282 at the top of the body.

The passage 268, preferably has a cylindrical configuration conducive to use of rotating parts therein and can also have one or more sections to accommodate the size and shape of various parts therein. As shown the passage has an upper portion 276 which is preferably of a narrower cross-sectional diameter as shown in FIG. 32 to correspond to the dimensions of the spindle 257, and a lower wider cross-sectional diameter section 278 that is preferably wider to accommodate other parts of the valve such as a disk, sealing rings and rotatable base portion of the spindle.

The body further includes at least one side opening 282 extending transversely through the body from the interior passage 268 to the exterior surface of the body 90. The side opening 282 is preferably located to be compatible with traditional faucet design in that water or other fluid flowing upwards through the inlet end 270 of the body into passage 268 would encounter the stationary disk and pass through the opening therein when in the open valve mode until it entered the receiving area of the moveable disk and could then flow out the side opening 282 in the body to continue on to feed the faucet body and outlet of the faucet.

Thus the side opening 282 for this embodiment should preferably be positioned to accommodate that flow in an unimpeded manner within the design. The opening is preferably rectangular for fluid flow characteristics but can have other configuration in order to meet some design or aesthetics. As shown two such side openings 282 are shown which is compatible with the number of openings and receiving areas in the disk cartridge.

The spindle 257 of cartridge 204 has a lower portion 286 which is configured to fit in rotatable relationship with the interior passage 268 of the body 290 when situated within the passage 268 of the said body 290. As shown the lower portion of the spindle sits within the passage and has one or more seals to prevent leakage around the spindle. One O-ring 272 is placed above the lower end portion 286 of the spindle 257, which as shown in this embodiment is somewhat wider than the rest of the spindle and sits within a groove 285 in the lower end portion 286 of the spindle 257, which is situated in the lower portion 278 of the passage 268 of the body 290. The lower end portion of the spindle preferably has such a groove on its exterior surface for receiving a seal such as O-ring capable of providing sealing engagement between the interior surface of the body and the lower end portion of the spindle.

The upper end portion of the spindle may preferably have a threaded or other snap-fit, slide in fit, friction fit or gripping surface for attaching the cartridge to a faucet handle so as to be rotatable and function with the handle. The lower end portion 286 of the spindle 257 has a bottom surface 296. The upper end portion 258 of the spindle 257 as shown in FIG. 29 is configured to be fitted within a faucet handle 220 assembly.

Figure 30:
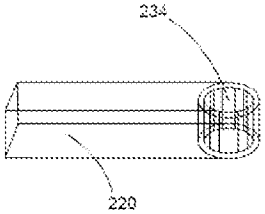
FIG. 30 shows a lever in faucet handle assembly in accordance with one embodiment of the present invention.

The bottom surface 296 preferably has a feature which allows for interaction with a movable disk so that when the upper portion 258 of the spindle 257 is fitted within a faucet handle assembly 220 depicted in FIG. 30 and turned a predetermined angle, it will then in turn, turn the moveable disk and activate the open/close feature of the cartridge.

The rotational movement of the spindle in response to the faucet handle when interconnected and/or interacting with the moveable disk effects opening/closing operation of the cartridge. Thus, some feature to allow such rotational interaction with said spindle when said spindle 257 is in turning. As preferred, the bottom surface 296 has a tab or opening therein which can interlock with a matching tab or opening in the moveable disk. A tab 298, preferably rectangular prism in shape is shown in FIG. 18 which fits in a slot 200 in a moveable disk 202 so that turning of a faucet handle interacting with a spindle 257, turns the said spindle 257 that also turns the moveable disk 202 for opening and closing the cartridge valve. The spindle may preferably be formed from metal or other material ensuring structural integrity and safe for coming in contact with drinking water. The spindle may be formed of a one piece construction, wherein the whole spindle is formed of stainless steel or other safe metal or wholly of a plastic.

The moveable disk 202 included within the body in the passage 268 is enabled with means on its upper surface 204 configured to contact and interact with the bottom surface 296 of the lower end portion of the spindle 286 in a rotatable relation. As shown, the upper surface 204 is preferably configured with a slot 200 for receiving a tab 298 therein. The disk upper surface may preferably be defined as a portion of the cross-section of a solid cylinder defined by symmetrically parallel chords shaped to fit within a preferred generally cylindrical portion of the passage 268 in the lower portion 278 in the passage 268. There is preferably two side wall portion 108 defining preferably two fluid receiving area 210 within the moveable disk 202. The receiving area 200 is configured so that when the disk 202 is rotated to align the receiving area 200 with the side opening 282 in the body 268 it will allow fluid flow out of the side opening of the body for feeding the faucet to which to is installed with fluid entering the cartridge from a conduit through the open inlet 270 of the cartridge.

A stationary disk 212 is also included in the design that works with the moveable disk by providing at least one opening 214 extending through the stationary disk 212 for allowing passage of fluid flow from an inlet end 270 of the body 290 entering the passage 268, then through the stationary disk and into the receiving area 210 of the moveable disk, and then out the side opening 282 of the body when the cartridge is in the open position mode. The stationary disk 212 is enabled with a feature 215; the function of feature 215 will subsequently become apparent in this application.

Thus when the opening 214 in the stationary disk is aligned with designed so as to fit within faucet handle is turned to reduce and shut off flow; the handle thus initiates the closing of the valve when said handle is initiated to turn in the valve closure turning mode to the off position.

In further embodiments of the invention, an upper surface 230 at the outlet end 274 of the said body 290 may also have one or more stops feature. For example at least one raised stop feature may be placed on the upper face 230 for limiting rotational movement of the valve cartridge when in use and actuated by a faucet. This helps for smooth faucet use, limited range of motion consistent with disks openings and a desired mating of the various flow openings within a particular predetermined rotational range. As shown in FIG. 29, two raised stop features 260 are shown.

Said stop features 260 enabled on a circumference of a circle on said upper surface 230 are arranged such that with the center of said circle, said stop features 260 define with the radius of said circumference, a reflex angle and an obtuse angle. Said center said circle being a point on the axis of rotation of spindle 257 substantially in a plane defined by upper surface 230.

Said stop features 260 enabled on a circumference of a circle on said upper surface 230 enables un-obstructive use of faucet when said lever arm 20 has been turned through preferably through the obtuse angle.

Liquid is enabled to flow through portion 8 of spout 10 of faucet assembly depicted in FIG. 25 when the angle of turn of said moveable disk 202, relative to said fixed disk 212, moves simultaneously in unison through the angle defined by the initial activation of stop feature 260; thus enabling positioning of lever arm 20 to intercept the line of flow from spout portion 8 of spout 10. Said rotation of component handle 20 is designed to be limited by stop feature 60.

Said angle of turn of said moveable disk 202 relative to said fixed disk 212 moves simultaneously in unison through angle defined by the turning of said rotation of component handle 20 but limited by stop feature 260, wherein said angle of turn of lever 20 is defined optimally by a reflex angle and obtuse angle of said wedges 260. Said handle of turn is preferably the obtuse angle defined by the point location of stop feature 260 on the circumference of a circle with enter a geometric point of location of the spindle 257. Thus turn of handle 20 may subsequently enable turn of spindle 257 thus enabling opening and closing of valves and thus enables lever handle to be washed by fluid when said faucet is activated for its function. Thus each use of the tap can inherently cause a showering of the lever thus mitigating the spread of pathogens; said inherent showering of the lever 20 is enabled because said lever arm 20 moves through an angle in a horizontal plane that is greater than the angle turned to the said line of flow 22 thus the inherent showering is enabled when the initial angle of turn of the lever to get liquid flowing along line of flow 22 is reversed to enable positioning of lever arm back to a rest positioning in which flow of liquid is disabled.

Figure 37:
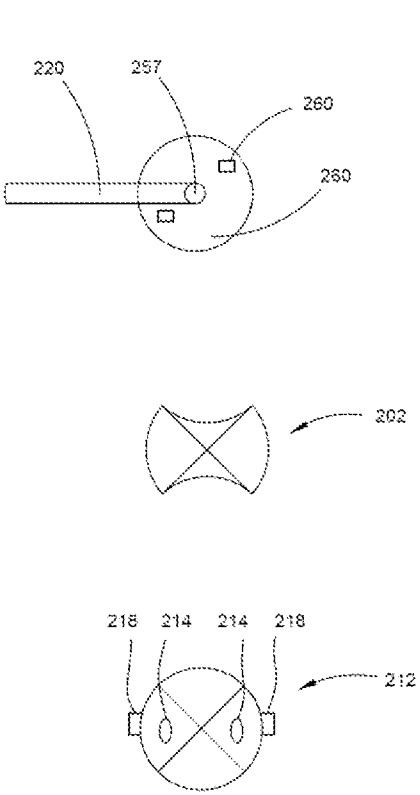
FIG. 37 shows the order of contiguous assembly and relative orientation of the handle in FIG. 10, the position of tabs, the orientation of the moveable disk and the stationary disk when faucet system is in the off mode but disposed to enable flow of liquid to said faucet when activated.

Referring to FIG. 37, what is shown is the order of contiguous assembly and relative orientation of the handle 20 depicted in FIG. 30, the position of tabs 260, the orientation of the moveable disk 202 and the stationary disk 212 when faucet system is in the off mode and but disposed to enable flow of liquid to said faucet when activated.

Figure 38:
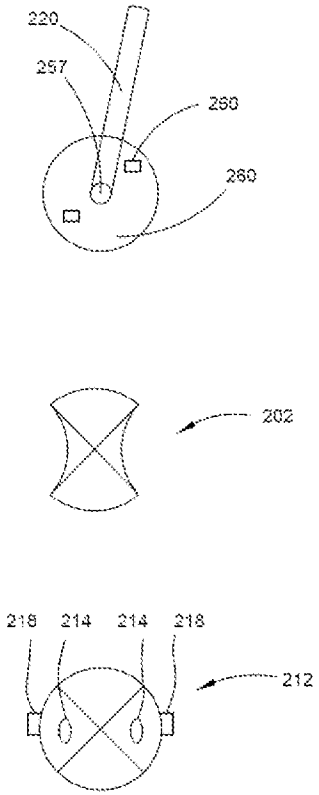
FIG. 38 shows the order of contiguous assembly and relative orientation of the handle in FIG. 37, the position of tabs, the orientation of the moveable disk and the stationary disk when faucet system is in the on mode.

Referring to FIG. 38; what is shown is the order of contiguous assembly and relative orientation of the handle 20 depicted in FIG. 30, the position of tabs 260, the orientation of the moveable disk 202 and the stationary disk 212 when faucet system is in the turned on mode and liquid flow is enabled and thus flows to said faucet.

The stationary disk 212 is enabled with means for ensuring stability and reliability of the faucet system; said means for stability may be achieved by inclusion of locking tabs 218; said tab 218 can be designed to fit within similar openings on the interior passage 268 of the body 290; said tab 218 may be an abutment of the side wall of stationary disk 212 preferably capable of interacting with the interior passage 268 of the body 290 so as to help stabilize the disk 212 in place and with other parts within the body. As there may be more than one side opening 282 in the body 290, and more than one receiving area 210 in the moveable disk, then there may also be more than one opening 214 in the stationary disk to accommodate flow.

A sealing O-ring 216 is included within component 232 and functions to apply pressure between 232 stationary valve member 202, and rotary valve member 212. The pressure exerted by O-ring 216 ensures optimal functioning of the cartridge for flow of liquid. The stationary disk is enabled with a feature 215 that increases the velocity of fluid through openings 214 of the stationary disk thus reducing pressure on the sealing zone of O-ring 216.

For seating the cartridge, it is also preferred that the body further includes an outer seal. For seating the cartridge on installation in a fluid conduit. Such sealing may be accomplished by providing a sealing groove 224 on the exterior surface 268 of the body for receiving a seal, such as an O-ring 226. The exterior surface 266 of the body 268 may also preferably include at least one feature, such as a locking tab or snap fit mechanism on its upper outlet end portion on or near the outlet 274 of the body for use in seating the valve cartridge within or on a fluid conduit having a mating feature placed thereon. As shown a locking tab 218 is shown that can interlock with a receiving opening in a conduit. However, other locking or stabilizing features can also be used as desired. Two or more of such locking tabs, including two opposed locking tabs may be provided within the scope of the invention. An O-ring 88 fits around the lower surface of the body inlet 270; said O-ring 288 helps to provide a fluid resistive seal between the faucet body 290 and the inlet 270. O-ring 217 provides a fluid resistive seal on the outer surface of the body 290 and positioned between body 290 and inlet assembly 232

Other features and advantages will become apparent from the following description preferably taken relative to the accompanying drawings, which in combination discloses an embodiment of the invention. An apparent alternative includes the said rotary motion of said lever arm wherein said restrictive on said rotary arm is influenced and enabled by internal flanges and recesses on the said moveable component and on said stationary component wherein said flanges and said recesses function in compatibility to ensure said limitations on the rotary movement of said rotary arm component.

Additional features, advantages, and embodiments of the disclosed subject matter may be set forth or apparent from consideration of the following detailed description, drawings, and claims. Moreover, it is to be understood that both the foregoing summary and the following detailed description are illustrative and are intended to provide further explanation without limiting the scope of the claims.

What is claimed is:

1. A faucet assembly with a washable handle comprising:

a faucet spout with a base having a fluid conduit diameter and defining a fluid conduit axis spanning through a centroid of the fluid conduit diameter, defining a spout aperture, and a median spout axis spanning through a portion of the faucet spout defining the spout aperture, the faucet spout coupled to a fluid conduit; and a lever handle member offset from the fluid conduit axis a handle offset length, a, separating the fluid conduit axis and a fulcrum axis in which the lever handle member is operable to rotate, rotatably coupled to a valve cartridge assembly with an inlet opening defined thereon, about a fulcrum point on the valve cartridge assembly, with a distal free end, with a lever handle length, c, separating the fulcrum point and the distal free end, with the fulcrum axis and the fluid conduit axis axially disposed in a parallel and vertically aligned configuration with one another, and operably configured to:

rotate at least 130° along a handle rotation plane and a handle rotation path with respect to the fulcrum point;

modulate a valve on the valve cartridge assembly to a flow position along the handle rotation path to fluidly couple the inlet opening on the valve cartridge assembly with the spout aperture and a closed position along the handle rotation path to fluidly uncouple the inlet opening on the valve cartridge assembly with the spout aperture; and rotate along the handle rotation path, and while in the flow position, with at least a portion of the lever handle member along with the lever handle length, c, disposed underneath the spout aperture, thereby enabling a downward direction of liquid flow operably configured to be emitted from the spout aperture to intercept with the portion of the lever handle member.

2. The faucet assembly with a washable handle according to claim 1, wherein:

the portion of the faucet spout defining the spout aperture is enclosed.

3. The faucet assembly with a washable handle according to claim 1, wherein the faucet spout further comprises:

a terminal end of the base of the faucet spout; and a spout length, b, separating the median spout axis and the fluid conduit axis.

4. The faucet assembly with a washable handle according to claim 3, wherein:

the spout aperture is disposed above the entire handle rotation plane.

5. The faucet assembly with a washable handle according to claim 3, wherein the faucet assembly includes a relative geometric spacing configuration of $\sqrt{a^2+b^2} \leq c$.

6. The faucet assembly with a washable handle according to claim 5, wherein:

the fluid conduit axis, the fulcrum axis, and the median spout axis are all vertically aligned with one another in a parallel orientation.

7. The faucet assembly with a washable handle according to claim 6, wherein:

the handle rotation plane is disposed at a 90° orientation with respect to the fulcrum axis and the median spout axis.

8. In combination with a faucet assembly having a faucet spout having a base directly coupled to an upper surface of a sink, defining a spout support axis spanning through the base, defining a spout aperture dispose above the upper surface of the sink directly coupled to the base, and a median spout axis spanning through a portion of the faucet spout defining the spout aperture, the faucet spout coupled to a fluid conduit coupled to the base of the faucet spout, the improvement comprising:

at least one washable handle assembly coupled to the upper surface of the sink, including a lever handle member rotatably coupled to a valve cartridge assembly with an inlet opening defined thereon and fluidly coupled to a liquid source, about a fulcrum point on the valve cartridge assembly defining a fulcrum axis, with a distal free end, with a lever handle length, c, separating the fulcrum point and the distal free end, with a handle offset length, a, separating the spout support axis and the fulcrum axis, the spout support axis and the fulcrum axis axially disposed in a parallel and horizontally aligned configuration, and operably configured to:

continuously rotate at least 90° along a handle rotation plane and a handle rotation path with respect to the fulcrum point;

modulate a valve on the valve cartridge assembly to a flow position along the handle rotation path to fluidly couple the liquid source with the spout aperture and a closed position along the handle rotation path to fluidly uncouple the liquid source with the spout aperture; and rotate along the handle rotation path, and while in the flow position, with at least a portion of the lever handle member along with the lever handle length, c, disposed underneath the spout aperture, thereby enabling a downward direction of liquid flow from the liquid source to intercept with the portion of the lever handle member; and a spout length, b, separating the median spout axis and the spout support axis, wherein the faucet assembly includes a relative geometric spacing configuration of $\sqrt{a^2+b^2} \leq c$.

9. The improvement according to claim 8, wherein:

the lever handle member is operably configured to rotate at least 130° along the handle rotation plane and the handle rotation path with respect to the fulcrum point.

10. The improvement according to claim 8, wherein the faucet spout further comprises:

a terminal end of the base of the faucet spout;

the fluid conduit housed within, and spanning through, the base of the faucet spout, with a fluid conduit diameter, and defining a fluid conduit axis spanning through a centroid of the fluid conduit diameter and forming the spout support axis; and the spout length, b, separating the median spout axis and the fluid conduit axis.

11. The improvement according to claim 8, wherein:

the spout aperture is disposed above the entire handle rotation plane.

12. The improvement according to claim 8, wherein:

the spout support axis, the fulcrum axis, and the median spout axis are all vertically aligned with one another in a parallel orientation.

13. The improvement according to claim 8, wherein:

the handle rotation plane is disposed at a 90° orientation with respect to the fulcrum axis and the median spout axis.

14. A faucet assembly with a washable handle comprising:

a faucet spout:

with a base;

defining a spout aperture;

defining a median spout axis spanning through a portion of the faucet spout defining the spout aperture;

with a terminal end of the base of the faucet spout;

coupled to a fluid conduit housed within, and spanning through, the base of the faucet spout, with a fluid conduit diameter, and defining a fluid conduit axis spanning through a centroid of the fluid conduit diameter; and with a spout length, b, separating the median spout axis and the fluid conduit axis; and a lever handle member rotatably coupled to a valve cartridge assembly with an inlet opening defined thereon, about a fulcrum point on the valve cartridge assembly, with a distal free end, with a lever handle length, c, separating the fulcrum point and the distal free end, and operably configured to:

rotate at least 130° along a handle rotation plane and a handle rotation path with respect to the fulcrum point;

modulate a valve on the valve cartridge assembly to a flow position along the handle rotation path to fluidly couple the inlet opening on the valve cartridge assembly with the spout aperture and a closed position along the handle rotation path to fluidly uncouple the inlet opening on the valve cartridge assembly with the spout aperture; and rotate along the handle rotation path, and while in the flow position, with at least a portion of the lever handle member along with the lever handle length, c, disposed underneath the spout aperture, thereby enabling a downward direction of liquid flow operably configured to be emitted from the spout aperture to intercept with the portion of the lever handle member.

* * * * *